United States Patent [19]

Mode

[11] Patent Number: 4,876,427

[45] Date of Patent: Oct. 24, 1989

[54] LOCKING, DOUBLE-LAYERED MICROWAVE PACKAGE

[75] Inventor: Duane R. Mode, Bloomington, Minn.

[73] Assignee: Waldorf Corporation, St. Paul, Minn.

[21] Appl. No.: 173,308

[22] Filed: Mar. 25, 1988

[51] Int. Cl.[4] ..... H05B 6/80

[52] U.S. Cl. ..... 219/10.55 E; 219/10.55 F; 99/DIG. 14; 426/107; 426/241; 426/243

[58] Field of Search ..... 219/10.55 E, 10.55 F, 219/10.55 M, 10.55 R; 426/107, 113, 114, 234, 241, 243; 99/DIG. 14, 451

[56] References Cited

U.S. PATENT DOCUMENTS

| | | | |
|---|---|---|---|
| 3,281,051 | 10/1966 | O'Brien et al. . | |
| 3,997,677 | 12/1976 | Hirsch et al. . | |
| 4,038,425 | 7/1977 | Brandberg et al. . | |
| 4,190,757 | 2/1980 | Turpin et al. . | |
| 4,469,258 | 9/1984 | Wright et al. . | |
| 4,590,349 | 5/1986 | Brown et al. . | |
| 4,713,510 | 12/1987 | Quick et al. | 219/10.55 E |

OTHER PUBLICATIONS

Cardboard carton for holding two 8 oz. tubs of margarine.

*Primary Examiner*—A. D. Pellinen
*Assistant Examiner*—Leon K. Fuller
*Attorney, Agent, or Firm*—Dorsey & Whitney

[57] ABSTRACT

A package for holding and microwave cooking of food comprising two or more food holding units, each having the shape of a generally rectangular box with opposed, opens ends and comprising, a first panel having a microwave absorbing heating surface facing the interior of the package, a second panel located opposite, spaced from and substantially parallel to the first panel and having a microwave absorbing heating surface facing the interior of the package, and a pair of substantially parallel side wall panels of approximately equal height connecting the first panel and the second panel, each of the side wall panel having an opening between its ends, wherein each food holding unit has the same orientation as the others and is joined to at least one adjacent food holding unit at a weakened separation line that encircles the packages in a plane substantially perpendicular to the first and second panels.

12 Claims, 1 Drawing Sheet

LOCKING, DOUBLE-LAYERED MICROWAVE PACKAGE

TECHNICAL FIELD

The present invention relates to food packaging suitable for use in a microwave oven. More particularly, the present invention relates to a package in which food such as biscuits may be packaged, shipped and cooked.

BACKGROUND ART

In recent years, microwave ovens have become increasingly popular. This has created an increasing demand for economical, simple, disposable containers which, when used in a microwave oven, produce cooking results, including surface browning and crisping, comparable to those to which people are accustomed for cooking in conventional ovens. For consumer convenience, it is desirable that the package be so constructed that the food item, together with all or a portion of the package in which it is contained, can be placed directly in the oven.

Paperboard cartons have been found to be an economical way to meet many microwave packaging requirements. In particular, a number of cartons for browning microwave foods have been successfully sold that are made from paperboard to which a metallized plastic film has been laminated, with the thin metal layer being sandwiched between the plastic film and the paperboard. A suitable adhesive is used to hold the laminated layers together. One laminated material of this kind is shown in U.S. Pat. No. 4,641,005.

Although microwave browning packages of several kinds are now widely sold and the surface browning capability of a metallized film-paperboard laminate used in such packages is widely accepted, the effect of unusual food and package shapes, of multiple layers of microwave absorbing materials and of other specialized package configurations on cooking results is not well understood. This is apparently attributable to the complex combination of reflections, refractions and absorptions of microwave radiation occuring in the oven, the food and the packaging. Accordingly, development of specific package configurations has preceded slowly and empirically, as the microwave cooking possibilities of various food items are explored. Many of the microwave cooking packages first developed were for products such as pizza and popcorn. Because of their specialized configuration, these packages are not effective for a food item such as a biscuit that needs browning on two surfaces located some distance apart. Accordingly, there is a need for packaging for effective microwave cooking of biscuits and other similarly shaped food objects.

SUMMARY OF THE INVENTION

In accordance with the present invention, a package for holding and microwave cooking of food comprises a plurality of food holding units. Each unit is a generally rectangular box having opposed open ends. The generally rectangular box is formed by a first panel having a microwave absorbing heating surface facing the interior of the package, a second panel located opposite and substantially parallel to said first panel and also having a microwave absorbing heating surface facing the interior of the package, and a pair of substantially parallel side wall panels of approximately equal height connecting the first panel and the second panel. Each side wall panel has an opening between its ends. The present invention also encompasses a flat blank that can be folded and locked into the preceding package configuration. The blank is made from a paperboard material having a layer of metallized plastic film laminated to the paperboard so that the thin metal layer is sandwiched between the plastic and the paperboard.

A primary objective of the present invention is to provide a package for holding and microwave cooking of a food item, such as a biscuit, that needs browning on both the top and bottom surfaces.

Another objective of the invention is to provide a package that can be produced in multiple, identical units joined at their edges but easily separable into single units.

A further objective of the present invention is to provide a simple, laminated paperboard blank from which a microwave cooking package can be formed and in which one of the package panels used for surface browning contains two microwave absorbing heating layers slightly separated from one another.

These and other objectives of the present invention will become apparent with reference to the drawings, the description of the preferred embodiment and the appended claims.

DESCRIPTION OF THE PREFERRED EMBODIMENT

Figure 1:
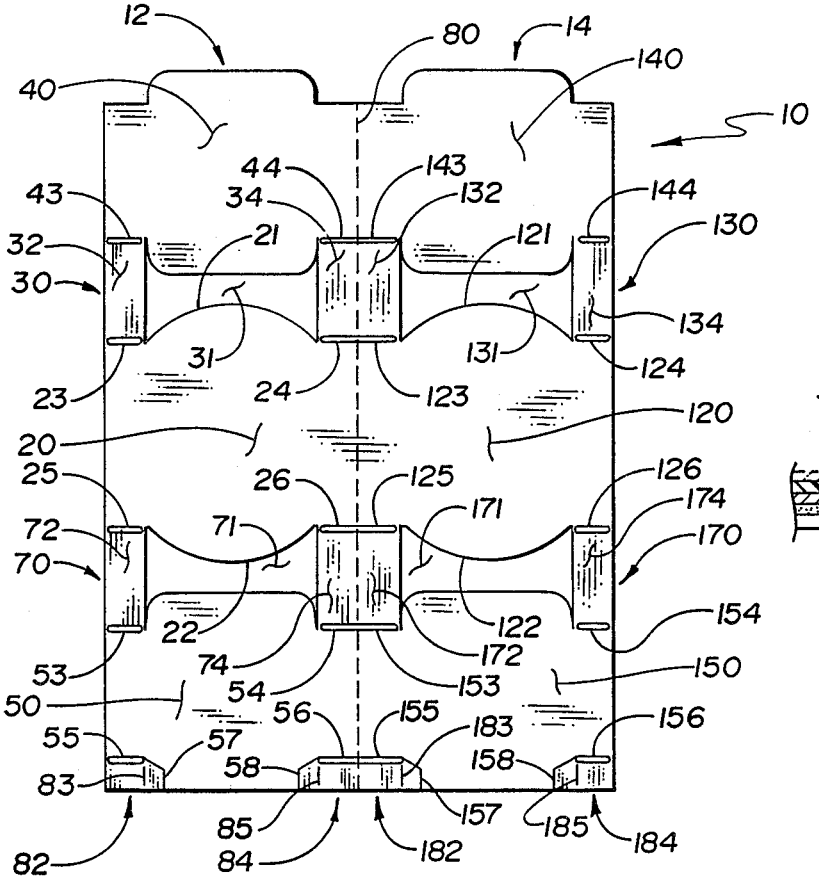
FIG. 1 is a top plan view of the laminated paperboard blank of the present invention showing the profile, cut outs, incisions and bending scores.

As best seen in FIG. 1, a blank 10 in accordance with the present invention contains one, two or more packaging units 12, 14. By way of example FIG. 1 shows units 12 and 14 joined in one blank 10. The first unit 12 is separated from the second unit 14 by a weakened line, such as a perforated line 80 running vertically (as shown in FIG. 1) across the blank. As each unit 12, 14 is the same, only the first unit 12 will be described in detail herein. It will be clear that the configuration of unit 12 is repeated in unit 14 and could be further repeated in additional units (not shown) joined at additional perforated lines at either the right or left-hand side of FIG. 1.

The package blank of unit 12 comprises a central panel 20 having a roughly square or rectangular shape. When the blank 10 is used to hold a circular food item, such as a biscuit, the opposing edges 21, 22 of the central panel 20 can be curved outward to conform to the shape of the food item. Attached to the opposing edges 21, 22 of the central panel 20 are side wall panels 30, 70. Each has a large opening, 31, 71, respectively, in its center, separating each of the panels 30, 70 into a pair of side wall legs 32, 34 and 72, 74, respectively. The side wall legs 32, 34 are joined to central panel 20 at colinear fold lines 23, 24. (These and other fold lines of the blank 10 are formed by bend scores, indicated by double lines in FIG. 1.) Side wall legs 72, 74 are joined to central panel 20 at colinear fold lines 25, 26.

Each of the side wall panels 30, 70 is joined to an additional panel. The side wall 30 is joined to a generally rectangular inner panel 40 at colinear fold lines 43, 44. The side wall panel 70 is joined to generally rectangular outer panel 50 at colinear fold lines 53, 54. The shape of inner panel 40 is almost identical to that of outer panel 50, except that outer panel 50 has lock tabs 82, 84 at its outer corners. Lock tab 82 is joined to outer panel 50 at fold line 55. The angled extension of fold line 55 is a cut line 57. Similarly, lock tab 84 is connected to outer panel 50 at fold line 56. The angled extension of fold line 56 is a cut line 58. Lock tabs 82, 84 have internal fold lines 83, 85, respectively, that are parallel to the separation line 70.

As can further be seen in FIG. 1, the second unit 14 has exactly the same shape as the first unit 12. That is, the blank of FIG. 1 is symmetrical around weakened line 80 that joins the two units 12, 14. For convenience in identifying the corresponding parts of units 12 and 14, the features of the second unit 14 are labeled with the same numbers as the corresponding panels in FIG. 12, but with a prefix "1" in front of the number used in connection with unit 12. That is, panel 140 in unit 14 corresponds to panel 40 in unit 12.

Figure 2:
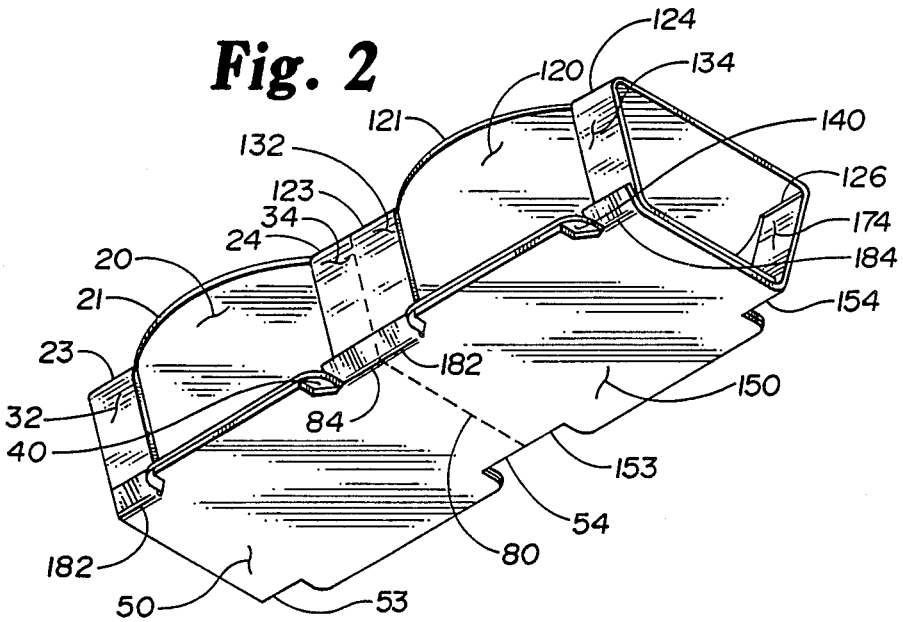
FIG. 2 is a pictorial view of a package in accordance with the present invention, assembled from the blank of FIG. 1.

FIG. 2 shows how the blank of FIG. 1 is folded into a carton configuration for holding a food item. For convenience in showing the overlapping and locking of inner panels 40, 140 with outer panels 50, 150, the package of FIG. 2 is shown inverted from the way it would normally be used in cooking. As shown in FIG. 2, the blank 10 is formed into a package by folding the blank 10 at one fold line comprised of the colinear fold line segments 43, 44, 143, and 144 and folding the blank again at the colinear fold line segment 23, 24, 123 and 124 to erect the side wall panels 30, 130. Similarly, folds are made at colinear fold line segments 25, 26, 125 and 126 and colinear fold line segments 53, 54, 153 and 154 to erect the second side wall panels 70, 170. When all of these folds are made at approximately 90 degrees so as to form a tube and the panels 40, 140 and 50, 150 brought toward each other, the outer panels 50, 150 can be superimposed onto the inner panels 40, 140 to form a double-layer panel.

To hold these panels in superimposition and the carton in its erected position, the lock tabs 82, 84, 182 and 184 are used. These tabs are bent slightly in the direction of the central panels 20, 120 at the colinear fold lines 55, 56, 155 and 156. The free edges of the lock tabs 82, 84, 182 and 184 defined at cut lines 57, 58, 157 and 158 are tucked under the rounded corners of the inner panel 40 that are adjacent to the fold lines 43, 44, 143 and 144 and the legs 32, 34, 132 and 134. When the lock tabs 82, 84, 182, 184 are tucked under as shown in FIG. 2, the panels 40 and 50 are superimposed and the panels 140 and 150 are superimposed, forming double layer panels. As can be seen from FIG. 2, a plurality of two or more food holding units having the same orientation as each other and joined at weakened lines such as the line 80 can be made by forming extended tubes from a sequence of identical, adjacent blanks 12, 14 as in FIG. 1.

Figure 3:
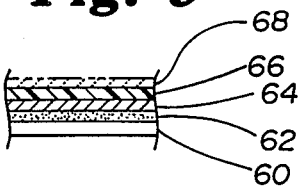
FIG. 3 is a greatly enlarged cross-sectional fragment of the laminated paperboard material used in the preferred embodiment of the invention, with one layer shown in phantom line.

FIG. 3 shows a fragmentary cross-section of a laminated material suitable for use in the present invention. The substrate is paperboard 60. A plastic film 66 (such as polyester film) with a layer of metallization 64 (such as vapor-deposited aluminum) is laminated to the paperboard using a suitable adhesive 62. If desired, a release coat 68 may be applied on top of the plastic film 66. In food browning applications the food surface to be browned is placed in contact with the surface of plastic film 66 (with or without a release coat 68). Accordingly, the blank 10 of the present invention is constructed with the plastic film 66 on the surface of the blank 10 that becomes the inside surface of the carton as shown in FIG. 2.

It will be recognized that when a blank 10 is erected in the manner shown and is made from a material as just described, the double layer formed by superimposed panels 40, 50 and 140, 150 has two layers of metallized film, one in each of the two layers of paperboard laminate. One layer of metallized film is immediately adjacent the package interior. The other is immediately adjacent the paperboard substrate of the inner layer. Thus, the food item surface adjacent this double layer has the possibility of exposure to twice the browning effect of the side exposed to only the single-layer panels 20, 120. In practice, the single layer panels 20, 120 are placed on the floor of a microwave oven. The double layer panels 40, 50 and 140, 150 are therefore significantly above the floor of the microwave. Thus, they receive a different pattern of direct and reflected microwaves, according to microwave wavelength, the thickness of the food article, the microwave transmission and absorption characteristics of the food article and other factors. It has been empirically established that in a biscuit of wheat flour approximately one to two inches (2.5 to 5 cm) thick, improved browning of the upper surface is obtained with the double layer of microwave absorbing material, as compared to only a single layer.

As shown in FIG. 1 the side walls 30, 70 and 130, 140 taper toward each other as they approach the double layer surface formed by superimposed panels 40, 50 and 140, 150. It has been found that this tapering aids in providing a tight fit on certain food item shapes, such as biscuits.

In sum, the package shown and described provides a convenient holder for a food item that can be placed with the food item directly in a microwave oven to enhance cooking, including browning of two surfaces. A certain amount of browning of side surfaces can also be obtained, although this depends on the size of the apertures in the side walls. The best overall cooking results appear to be obtained when these apertures are large. The inventive package is configured in individual units that can be joined together in chains of indefinite length at the time of production and packaging of the food. These chains can then be broken at convenient points to produce multiple unit groups or single units, as desired, for packaging and for use. Breaking two units at their separation line leaves the locking structure and panel configuration of each intact.

Although the description of a preferred embodiment has been presented, it is contemplated that various changes could be made without deviating from the spirit of the present invention. Accordingly, it is intended that the scope of the present invention be dictated by the appended claims rather than by the description of the preferred embodiment.

What is claimed and desired to be protected by Letters Patent is:

1. A package for holding and microwave cooking of food comprising two or more food holding units, each having the shape of a generally rectangular box with opposed, open ends and comprising:

(a) a first panel having a microwave absorbing heating surface facing the interior of said package;

(b) a second panel located opposite, spaced from and substantially parallel to said first panel and having a microwave absorbing heating surface facing the interior of said package; and (c) a pair of substantially parallel side wall panels approximately equal height connecting said first panel and said second panel, each said side wall panel having an opening between its ends, wherein each food holding unit has the same orientation as the others and is joined to at least one adjacent food holding unit at a weakened separation line that encircles the package in a plane substantially perpendicular to said first and second panels.

2. The package as recited in claim 1 wherein at least one of said first and second panels has a further microwave absorbing heating surface parallel to but exterior to and slightly separated from the microwave absorbing heating surface that faces the interior of the package.

3. The package as recited in claim 2 wherein all panels are made of paperboard to which a thinly metallized plastic film is laminated with the metal layer being sandwiched between the paperboard and plastic film.

4. The package as recited in claim 3 wherein the at least one panel having a further microwave absorbing heating surface comprises a double layer of said laminated paperboard.

5. The package as recited in claim 4 wherein the side wall panels on opposite sides converge toward each other.

6. The package as recited in claim 1 wherein the plane of each weakened separation line intersects the first and second panels and the side wall panels that join them to define the boundary between one food holding unit and another.

7. A flat blank for forming a package having at least a first and a second food unit for holding and microwave cooking of food, each of said food units being configured and connected in the same manner and each comprising:

a central panel of generally rectangular shape having opposed side edges;

a pair of connection wall panels attached to said central panel at opposing side edges thereof, each said wall panel having an aperture between its ends;

a generally rectangular inner panel joined to one of the opposing side edges of said central panel by one of said connection wall panels; and a generally rectangular outer panel joined to the other of the opposing side edges of said central panel by the other of said connection wall panels, said first and second food units being joined to each other along a weakened line extending perpendicular to the opposing edges of said central panel.

8. The blank as recited in claim 7 wherein said outer panel has a pair of locking tabs attached to the corners of said outer panel that are opposite the edge at which the adjacent connection wall panel joins the outer panel to the central panel.

9. The blank as recited in claim 7 wherein the blank is made from a paperboard material to which a metallized plastic film is laminated, so that the metal layer is sandwiched between the paperboard and plastic film.

10. The blank as recited in claim 7 wherein the inner and outer panels are substantially the same size and shape.

11. The blank as recited in claim 7 wherein the aperture in each side wall encompasses a larger area than the area of the portions of said wall panel surrounding said aperture.

12. The blank as recited in claim 7 wherein the opposing side edges of said central panel are curved outwardly from the center of the central panel.

* * * * *